United States Patent [19]

Nobile et al.

[11] Patent Number: 5,057,827

[45] Date of Patent: Oct. 15, 1991

[54] MEANS AND METHOD FOR PRODUCING AN OPTICAL ILLUSION

[76] Inventors: Fred E. Nobile, 4126 Palisades Rd., San Diego, Calif. 92116; Richard V. Baxter, Jr., 600 E. Washington St., Appleton, Wis. 54911

[21] Appl. No.: 258,853

[22] Filed: Oct. 17, 1988

[51] Int. Cl.[5] ..... G09G 3/00

[52] U.S. Cl. ..... 340/755; 340/716; 359/221; 359/212; 359/36

[58] Field of Search ..... 340/755, 7.6; 350/331 R, 6.91

[56] References Cited

U.S. PATENT DOCUMENTS

| | | | |
|---|---|---|---|
| 4,160,973 | 7/1979 | Berlin, Jr. | 358/88 |
| 4,298,868 | 11/1981 | Spurgeon | 340/755 |
| 4,451,874 | 5/1984 | Friedman | 340/755 |
| 4,689,604 | 8/1987 | Sokol . | |
| 4,698,498 | 10/1987 | Mahoney et al. | 350/6.4 |
| 4,888,126 | 12/1989 | Muellen et al. | 252/299.5 |

FOREIGN PATENT DOCUMENTS

0156544A2 10/1985 European Pat. Off. .

OTHER PUBLICATIONS

Richard Doherty, "Paperless Plotter for CAE", 11-1986, Electronic Engineering Times.

*Primary Examiner*—Alvin E. Oberley
*Assistant Examiner*—Regina Liang
*Attorney, Agent, or Firm*—Hill, Van Santen, Steadman & Simpson

[57] ABSTRACT

As a rotary member is rotated, light images are produced in a radial direction from the rotary member. The light images are produced in time or position division multiplexed fashion so that, although at any given instant, only a portion of an entire image is actually generated, due to the light persistence of an observer's eye, the observer will observe an entire image about the rotary member.

7 Claims, 7 Drawing Sheets

MEANS AND METHOD FOR PRODUCING AN OPTICAL ILLUSION

BACKGROUND OF THE INVENTION

The present invention relates generally to devices for displaying information or images and, particularly, to a device for producing an optical illusion of displayed information or images utilizing the phenomenon of light persistence of an eye and time and/or position division multiplexing techniques.

A variety of devices and/or methods exist for displaying information or images. Such devices and/or methods include liquid crystal displays (LCDs); plasma and fluorescent gas discharge screens; electro-luminescent displays; light emitting diodes (LEDs); cathode ray tubes (CRTs); and projection devices such as laser scanners and light valve projectors. Other devices include signs formed of incandescent lamp matrices and large area liquid crystal polymeric dispersion thin films.

These devices and/or methods suffer from certain drawbacks. Display devices such as liquid crystal displays have a limited viewing angle and a low contrast ratio between the displayed image and background. Gas discharge devices and electro-luminescent displays require very intricate and complex matrices. LED displays generally require high power consumption matrices and CRTs are bulky and require high supply and driving voltages. Projection devices are also bulky and have a limited resolution. Large area liquid crystal polymeric thin films have a limited temperature range and a low contrast ratio.

Another drawback common to such devices and/or methods is that information or images are generally presented on planar displays. As such, true three-dimensional presentation of images is limited.

U.S. Pat. No. 4,099,172 to Montanari et al. discloses an electronic visual display for alphanumeric characters. The display utilizes at least one LED to create at least one dot matrix for alphanumeric characters. A rotating prism made of a transparent material and having a hexagonal cross-section is interposed between the LED and an observer. In consequence of the rotation of the prism and of the different inclination of its faces, a virtual image of the LED is successively positioned at all of the points of a matrix of 5 columns. Turning on and off of the LED is synchronized with the rotation of the prism by means of a sensing device cooperating with a strobe wheel. The emitted light is modulated according to the desired character so that for each LED utilized, a full alphanumeric character is displayed.

U.S. Pat. No. 4,298,868 to Spurgeon discloses an electronic display apparatus that produces an optical illusion of various combinations of circular patterns such as circles or leaves with rounded end points. An array of LEDs mounted on the plane of a rotating disk is selectively activated to control the geometric patterns formed. The LEDs are driven by demodulators that convert an analog signal, the signal that selects the pattern to be formed, to a digital signal, the signal that drives the LEDs. The LEDs are driven without regard to the rotational position of the disk. Additionally, the images generated are presented in a planar format.

U.S. Pat. No. 4,383,244 to Knsuff discloses a multi-light display device wherein intensified LEDs are intermittently energized while in rotary motion. Use is made of the phenomenon of light persistence of an eye so that dots and bars are selectively perceived by an observer.

SUMMARY OF THE INVENTION

The present invention provides a device and method for producing an optical illusion of an image continuously viewable over a 360 degree sweep or latitude. To this end, a rotary member carrying thereon means for producing a series of light images is caused to rotate, and light images are caused to be produced in time or position division multiplexed fashion as the rotary member sweeps through a space. Due to the light persistence of an observer's eye, an optical illusion of an image will be perceived by the observer that is continuously viewable over the entire sweep of the rotary member even though, at any given instant, only a small portion of the image is actually produced.

In one embodiment, the invention includes a rotary member carrying linear arrays of light emitting diodes (LEDs) at its axial ends. As the member is rotated, the LEDs are caused to turn on and off in time or position division multiplexed fashion so that, to an observer, an image is generated over the path of the arrays. However, in actuality, at any given instant, light images are produced only along the LED arrays.

In another embodiment, the invention includes a liquid crystal film surface that serves as a light valve. Ion emitting elements are arranged in arrays that are carried on axial ends of a rotary member. The ion emitting elements are driven in time or position division multiplexed fashion as the member is rotated to cause selective transmission of light through the film and therefore, to generate an optical illusion of an image on the film surface.

In yet another embodiment, there is included a swivelable mirror mounted on a rotating shaft that is used to reflect and redirect a light source directed upward through the shaft, along its axis. The light source emanates from a laser or a laser diode. The redirected light is directed to a dispersion surface covering the device upon which the optical illusion is caused to appear. The laser or laser diode is turned on and off in time or position division multiplexed fashion as the mirror is positioned about its rotary and swiveling axes.

DETAILED DESCRIPTION OF THE PRESENTLY PREFERRED EMBODIMENTS

Figure 1:
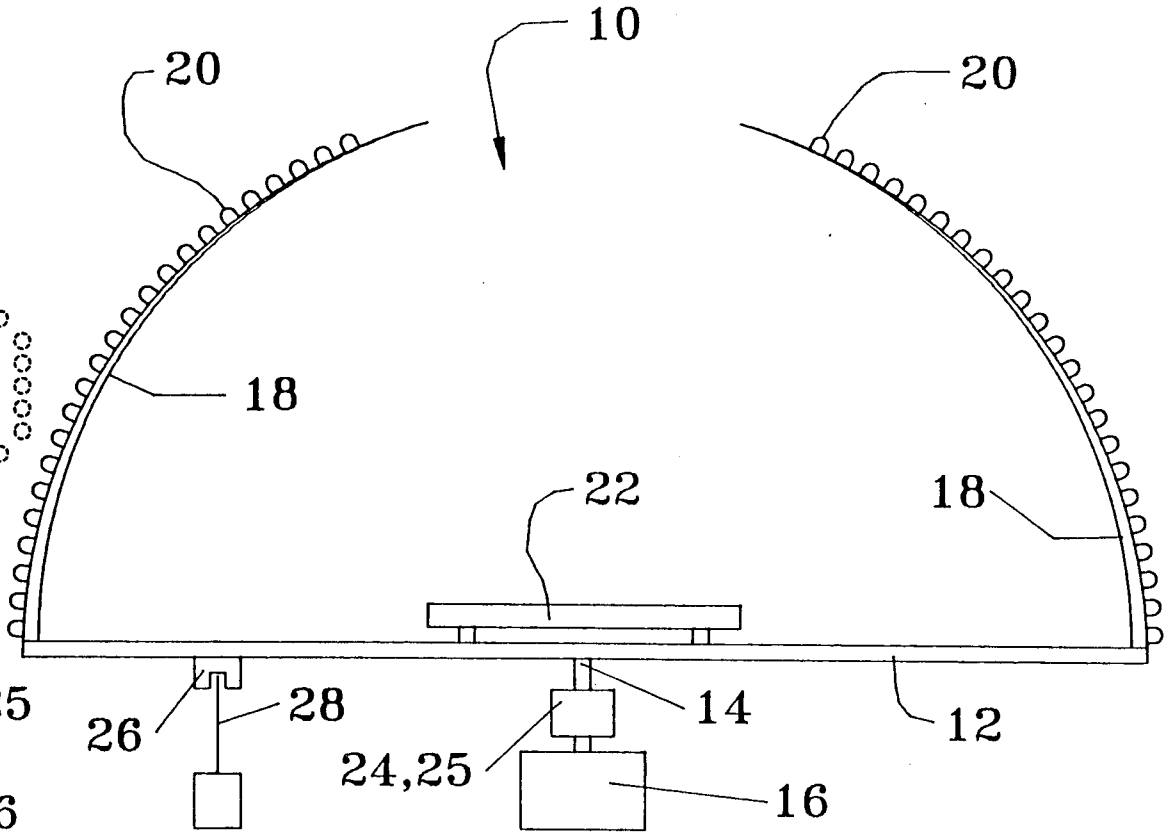
FIG. 1 is an elevational side view of a display device embodying principles of the invention and utilizing LEDs to produce an image.
Figure 2:
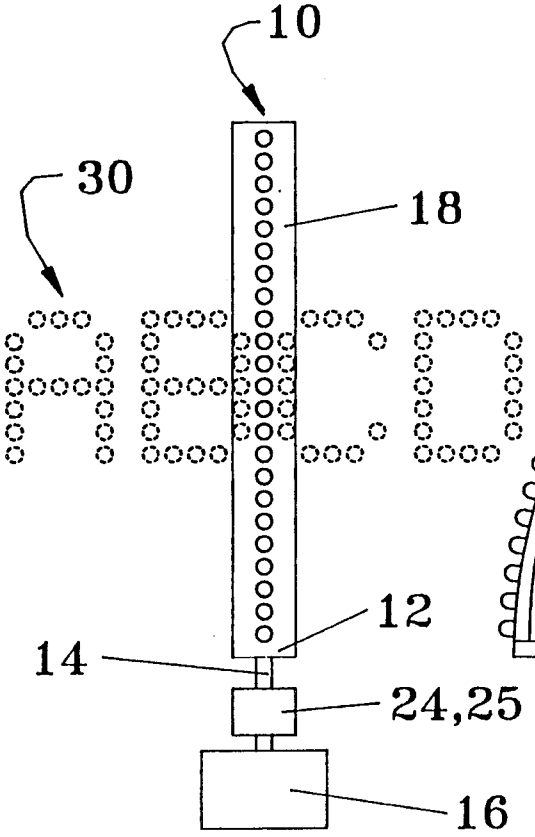
FIG. 2 is an elevational end view of the display device of FIG. 1.

In FIGS. 1 and 2, there is illustrated a display device 10 embodying principles of the invention. The device 10 includes an elongated rotary member 12 mounted for rotation upon a shaft 14. The shaft is mounted on and caused to rotate by a motor 16.

Located at each axial end of the rotary member 12 is an arcuate upstanding leg 18. Carried on each upstanding leg 18 is a linear array of light image producing elements such as LEDs 20. The LEDs can also be referred to generically as energy emitting elements.

Carried on the center of the rotary member 12 is electronic circuitry unit 22, used to drive the LEDs 20. Power and input information for the electronic circuitry is provided through slip rings 24 and 25, respectively. To determine the rotational position of the rotary member 12, an optical sensor 26 is mounted thereon that cooperates with a leaf member 28 that is stationary relative to the rotary member 12.

In operation, the rotary member 12 is caused to rotate by the motor 16. As the rotary member 12 rotates, the leaf member 28 interrupts a light beam associated with the optical sensor 26 once every rotation and the optical sensor generates an appropriate commencement of rotation signals indicating that the beginning of a rotation has commenced. The rotational position of the rotary member 12, at any given instant, is dependent on and determined by its rotational speed and the lapsed time from commencement of rotation.

Figure 8:
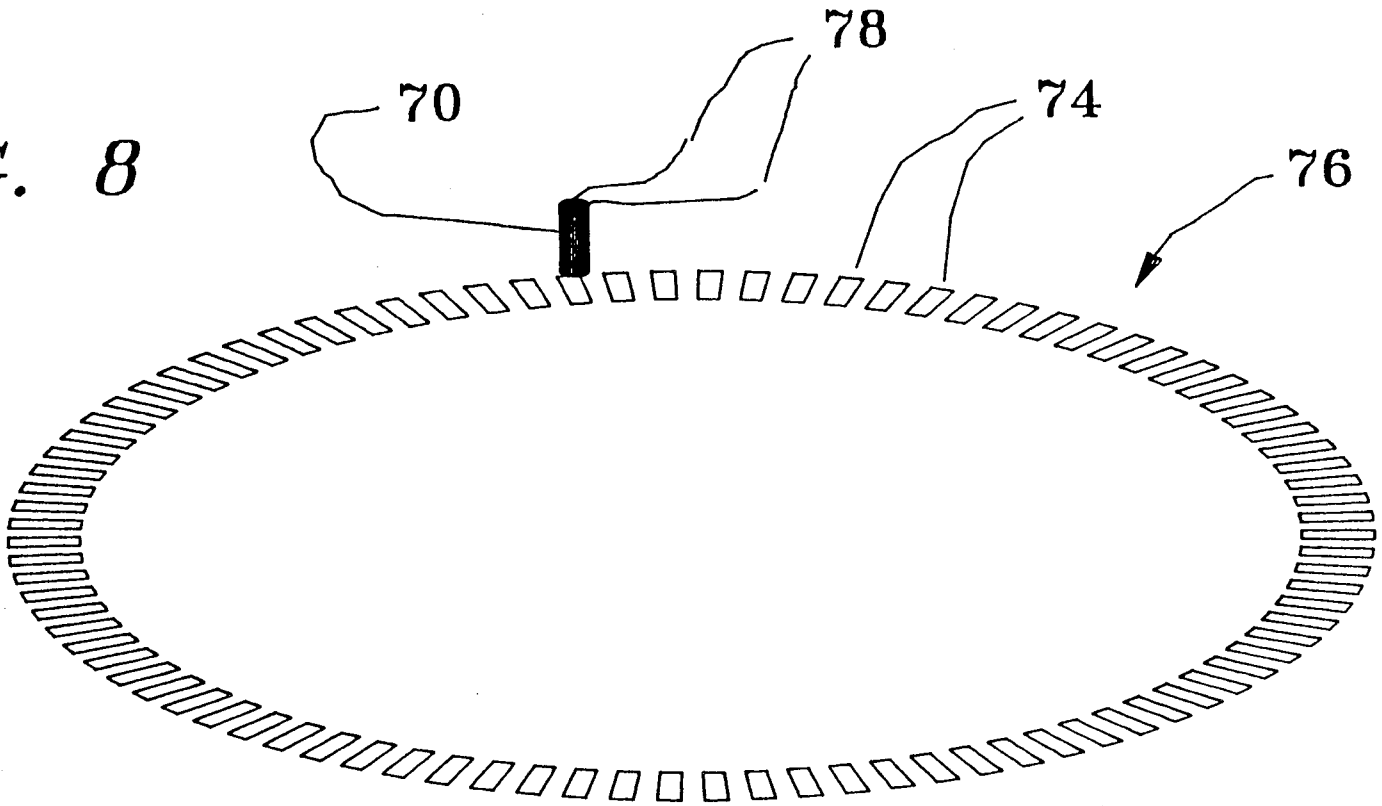
FIG. 8 is a perspective view of an infrared reflective type photo interrupter that can be utilized to determine the position of a rotary member used in the practice of the invention.

An alternate arrangement for determining the rotational position of the rotary member 12 is illustrated in FIG. 8. In the illustrated alternate arrangement, there is included an index wheel sensor or infrared reflective optical sensor 70 that cooperates with a circular arrangement of discrete reflective index stripes 74 that form an index wheel 76. The index stripes 74 are spaced apart equidistantly about the circular path and are positioned about the shaft 14. The index stripes 74 are stationary relative to the motor 16. The index wheel sensor or infrared reflective optical sensor 70 is appropriately attached to the rotary member 12 or the shaft 14 and has leads 78 over which appropriately positioned signals are generated.

It can be appreciated that as the rotary member 12 rotates, the index wheel sensor or infrared reflective optical sensor 70 generates signals indicating the presence or absence of an index stripe 74. Thus, a specific count of a series of such generated signals indicates the relative position of the rotary member 12. For example, if 192 index stripes are utilized, then a count of 146 generated signals indicates a rotation of 180° or one-half of a rotation.

The sensor 70 is also known as an infrared reflective type photo interrupter. But, while only an optical sensor has been disclosed, other sensors, even mechanical index sensors, can be easily utilized as well.

It can further be appreciated that when the index wheel sensor 70 and the index wheel 76 are utilized, the display device 10 is driven in position multiplexed fashion. In position multiplexing, longitudinal line portions of the overall images are generated at specific locations about the index wheel 76. In contrast, in time division multiplexing, longitudinal line portions of the overall image are produced at given elapsed times from commencement of one rotation. The times are calculated to correspond with a given rotational position on the basis of an assumed rotational speed.

The commencement of rotation signal is sensed by the electronic circuitry unit 22 which then commences to drive the LEDs 20 in time division multiplexed fashion in accordance with a predetermined sequence. The commencement of rotation can be indicated by the sensor 26, or if not included, by a signal generated by the index wheel sensor or infrared reflective optical sensor 70. The predetermined sequence is preferably established by computer software associated with the electronics. However, it is possible to establish the sequence through computer hardware or the like such as discrete components concluding digital logic chips that are hard wired in accordance with the sequence. In any event, as the rotary member 12 rotates, the upstanding legs 18 and, accordingly, the LEDs 20 are caused to sweep about a 360 degree path, which, in the illustrated embodiment, is a portion of a sphere. As the LEDs 20 are turned on and off, an observer will perceive an image 30, which in the illustrated embodiment consists of the letters A, B, C, and D. The image is reproduced by each upstanding leg 18 once every rotation, and thus, each rotation on the illustrated device 10 produces two display refreshes.

It is contemplated that rotational speeds of 150 to 1000 rpm are maintained by the motor 16. At 160 rpm, a displayed image can be maintained fixed relative to an observer, but it will flicker due to the slow refresh rate. Above about 900 rpm, the refresh rate is fast enough to produce a flicker-free display.

It can be appreciated that the letters 30 will have a curved shape as they will conform to the imaginary spherical surface on which they are produced. Further, it can be appreciated that an observer will see the backside of the letters should they be produced on a portion of the imaginary surface away from the observer. Thus, it can be said that the image produced by the device is truly three-dimensional as an observer can perceive the image from any angle as if it were a solid image in the air.

It can be appreciated further that, although the upstanding legs 18 are illustrated as being arcuate, the legs 18 can be of most any shape. For example, the legs could be in the form of an outline of a bottle. Thus, as the rotary member 12 is rotated, the LEDs 20 can be caused to turn on and off to produce a three-dimensional image of a bottle complete with appropriate lettering, such as a logo.

To accomplish the production of an image such as the image 30, the light image elements 20 must produce images at specific points in space. To this end, the imaginary surface defined by the upstanding legs 18 is subdivided into a matrix of pixels, each pixel representing a point at which an LED or light image element 20 can turn on. Further, it is necessary to turn off an LED 20 between adjacent pixels so that each pixel is clearly perceivable. Thus, in practice, the imaginary surface defined by the rotating upstanding legs 18 includes a matrix of pixels (points at which an LED 20 can turn on) separated by spaces called interpixels (points between pixels at which an LED 20 is turned off). Although at any given instant, only a single longitudinal line of pixels are lit by each upstanding leg 18, due to the light persistence of an eye, an observer will perceive that all of the pixels lighted during a sweep are lit, and the observer will perceive any image defined by the lighted pixels.

Figure 3:
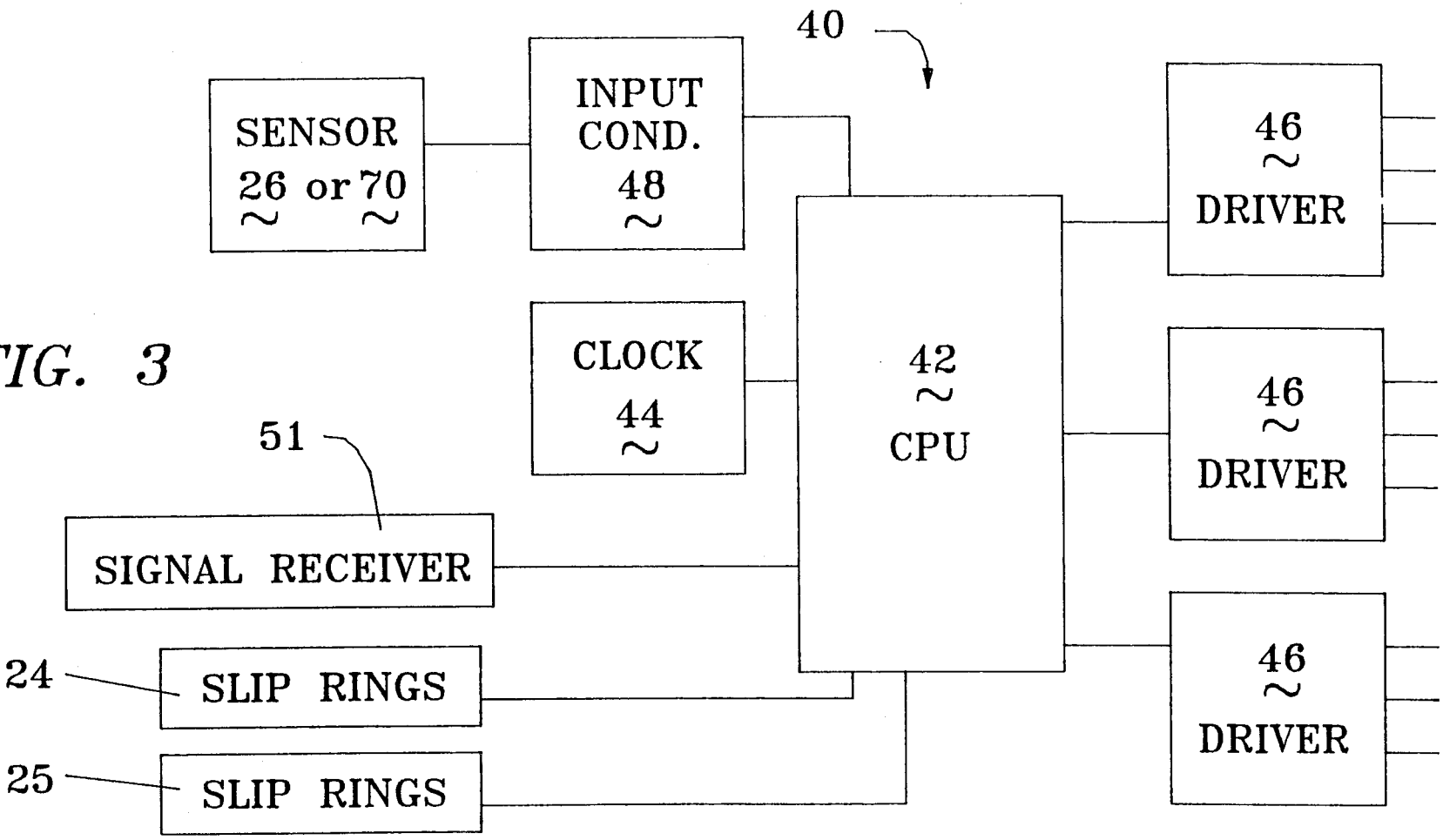
FIG. 3 is a block diagram of electronic circuitry embodying principles of the invention used to drive a display device in accordance with the invention.

In FIG. 3, there is illustrated a block diagram of an electronic circuit 40 that can be utilized to drive the LEDs 20. The circuit includes a central processing unit (CPU) 42 that, in the presently preferred embodiment, is a single chip microprocessor integrating a digital processor, random access memory (RAM), read only memory (ROM), timer units, and several input/output ports on a single chip. The CPU 42 is coupled to a clock unit 44 that causes the CPU 42 to pace through program instructions. Additionally, several energy emitting driver units 46 are coupled to output ports of the CPU 42.

The optical sensor 26 is also coupled to the CPU 42 through a gate or input conditioner 48. Thus, every time the light beam associated with the optical sensor 26 is broken by the leaf member 28, a signal is sent to the CPU 42, such signal indicating the beginning/end of one sweep of the rotary member 12. The CPU 42 can be caused to react in a variety of ways in response to receipt of a signal from the optical sensor 26. For example, the CPU 42 can be caused to execute a given set of program instructions over and over again to provide the necessary refresh of the image display.

Alternatively, the index wheel sensor 70 is coupled to the CPU 42 through the gate or input conditioner 42, instead of the optical sensor 26. Every time an index stripe 74 is detected, a signal is sent to the CPU 42, such signal indicating a new position of the rotary member 12 along its sweep. In response to receipt of the signal, the CPU 42 reacts by generating light images along each upstanding leg 18 that corresponds to one longitudinal line portion of the overall image to be produced.

As also illustrated in FIG. 3, power to the CPU 42 is provided through slip rings 24. The power is provided in this way because the CPU 42 and associated circuitry are mounted on the rotary member 12. Mounting of the CPU 42 and associated circuitry on the rotary member 12 reduces the number of slip ring connections required. Otherwise, a slip ring connection would be required for every light image producing device 20, or worse yet, every LED 20.

Serial input/output data can be provided over the slip rings 25 to the CPU 42. In the preferred embodiment, external apparatus can be used to effect a change in the operation of the CPU 42 so as to change the displayed image. A signal receiver 51, receives a data signal and then relays the data to the CPU 42. For example, an FM radio signal receiver or an infrared signal receiver associated with the display device 10 can receive data from a remote transmitter and transmit that data to the CPU 42. The data transmitted can be used by the CPU 42 to change the image displayed or the manner in which an image is displayed. The signal receiver 51 is located on the rotary member 12 as part of the electronic circuitry unit 22. The signal receiver 51 receives external data signals as it rotates on the rotary member 12 and then relays the received data directly to the CPU 42.

In accordance with the invention, a control computer program is appropriately stored within the read only memory of the CPU 42 so that upon turning on of the display apparatus 10, it will commence to execute the various tasks necessary to cause the display apparatus 10 to operate. The computer program also causes the drivers 46 to drive the LEDs 20 in time or position division multiplexed fashion upon rotation of the rotary member 12, so that the optical illusion 30, appears to an observer.

It is contemplated that the computer program running on the CPU 42 will operate in one of two modes: a character mode and a graphics mode. In the character mode, computer data for a character such as any character located on a typewriter keyboard, is converted from its eight bit code to pixel data format. The pixel format is a 5 by 7 matrix of pixels. Thus, at least 5 longitudinal lines are allocated for each character. If the computer program merely retrieves information for each longitudinal line on the imaginary sphere from a memory store, then at least 5 memory stores are required for each character, one bit of each memory store being allocated to each LED 20.

The conversion of a character code to pixel data can be accomplished by means of a look up table stored in the ROM of the CPU 42. Such techniques are frequently used in other standard 5 by 7 matrix displays.

In the graphics mode, there is a one-to-one correspondence between the pixels on the imaginary spherical surface and a memory store in the RAM associated with the CPU 42, each bit of a memory store being allocated to a pixel. Thus, noncharacter images can be inserted into the RAM of the CPU 42, bearing in mind the one-to-one correspondence, and then be displayed by the apparatus 10.

It is contemplated that operation in the graphics mode can entail at least two different methods for obtaining the one-to-one correspondence between a memory store and a pixel. In one method, each byte or word of memory corresponds to a pixel. Thus, a certain value placed within the memory word describes turning on or off of a light image element 20 whenever it is aligned with a specific pixel.

In another method, each bit in a memory word corresponds to a pixel. If, for example, the imaginary surface traveled by the light source elements 20 contains eight longitudinal pixels, then an eight bit or one byte memory word can be used to describe the turning on or off of the various light source elements 20 at a given point in the rotation of the rotary member 12. For example, a 1 in the third bit of a byte can indicate to or instruct the CPU 42 to turn on the third light source element from one of the ends of the strands of light image elements or LEDs 20.

Figure 4:
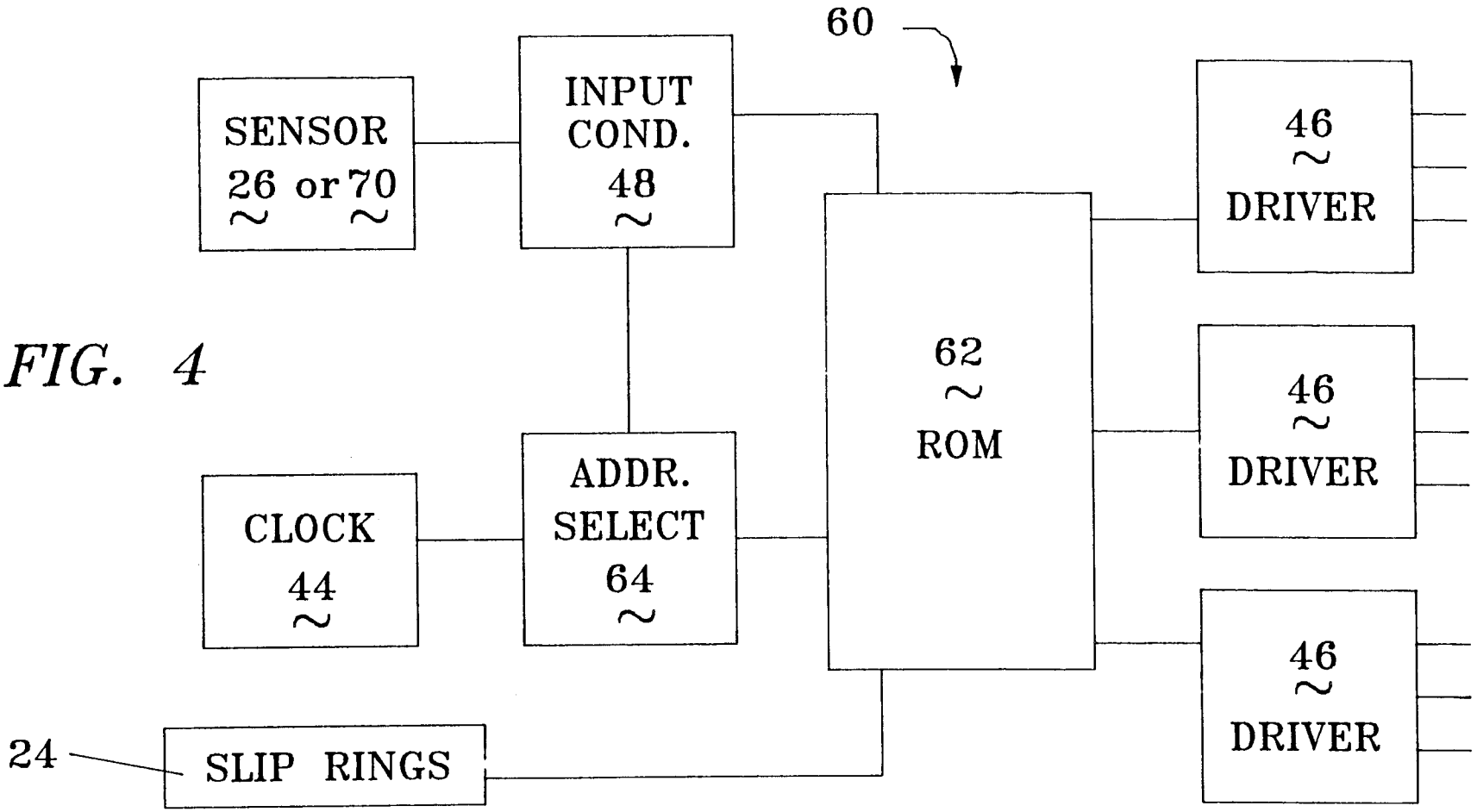
FIG. 4 is a block diagram of alternate electronic circuitry embodying further principles of the invention used to drive a display device in accordance with the invention.

In FIG. 4, there is illustrated an alternate electronic circuit 60 that can be utilized to drive the LEDs 20. In the circuit 60, the CPU 42 has been replaced by a read only memory chip (ROM) 62. Coupled to the ROM 62 is an address select unit 64, which address select is also coupled to the input conditioner or gate 48 and the clock unit 44.

The circuit 60 is used to drive the LED 20 with a fixed image stored within the ROM 62. No external data input is permitted so that the image cannot be changed without replacing the ROM 62. Accordingly, the slip ring 25 is not included. Thus, to a degree, the circuit 60 is a much simpler version of the circuit 50.

In the circuit 60, if the optical sensor 26 is used, the clock unit 44 causes the address select unit 64 to step through the addresses of the ROM 62. The timing of the clock unit 44 is such that during one revolution of the rotatable member 12, the address select unit 64 will step through a predetermined number of memory location addresses, one memory location corresponding to one longitudinal line along the spherical surface carved out by the rotatable member 12. If eight bit memory locations are used in the ROM 62, then each longitudinal line will include eight pixels, one pixel corresponding to each bit.

As the rotatable member 12 rotates, the optical sensor 26 will signal the beginning of a rotation as discussed previously. Each signaling of a beginning of a rotation will cause the address select 64 to reset to the address of the first memory location containing the first portion of the image to be displayed. Subsequently thereto, the address select unit 64 will be caused to pace through the ROM 62 by the clock unit 44.

If the index wheel sensor 70 is utilized in the circuit 60, then there is no need to establish the rotational position of the rotary member 12 based on time from commencement of rotation. Therefore, the clock unit 44 is not utilized to cause the address select 64 to slip through the addresses of the ROM 62. The clock unit 44 is not utilized at all. Instead, each signal generated by the index wheel sensor 70 will cause the addresses select 64 to step to the next address in the ROM 62. Thus, a series of signals from the index wheel sensor 70 will cause the address select unit 64 to step through a predetermined number of memory location addresses to generate an image having discrete longitudinal line portions.

Figure 5:
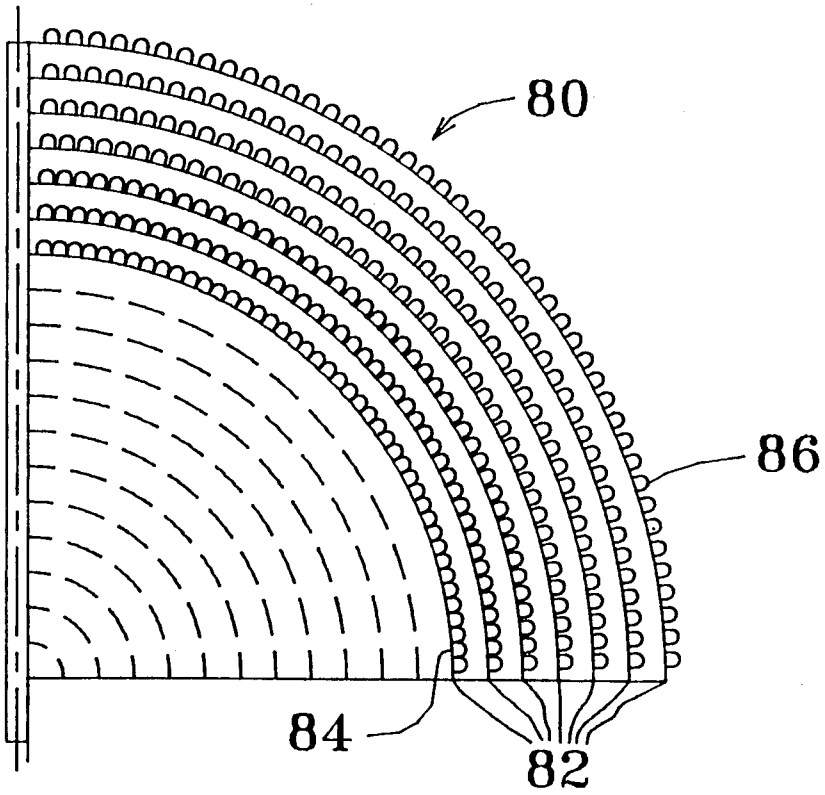
FIG. 5 is a fragmentary elevational side view of a second display device embodying principles of the invention.

Illustrated in FIG. 5 is a portion of another display device 80, that is similar to the device 10, but that includes a plurality of strands of LEDs 82 instead of the single strand of LEDs 20. The display device 80 is driven and operated in a similar fashion. Of course, additional drivers 26 coupled to the CPU 42 are necessary.

By encoding appropriate control software in the CPU 42, images displayed on the device 80 can be manipulated through various viewing angles. Images can be perceived to tilt, spin, rotate, or otherwise appear at any angle. Additionally, the image may be caused to explode from the innermost strand 84 of LEDs 82 to the outermost strand 86. Conversely, an image can be caused to diminish in size from the outermost strand 86 to the innermost strand 84. Thus, perspective views are possible.

To obtain perspective views, at least two schemes can be employed. In the first scheme, the outermost strand 86 has larger, further spaced-apart LEDs 82 than has the innermost strand 84. Thus, special software algorithms are not necessary to calculate the conversion of number of pixels required to produce an image at a given perspective or distance. Instead, images will appear to diminish according to distance due to the smaller sized, more closely-spaced LEDs.

In the second scheme, the LEDs 84 are all of uniform size, but the innermost strand 84 has less LEDs 82 than has the outermost strand 86. In this scheme, complicated software algorithms must be encoded into the ROM of the CPU 42 to calculate the required conversions between various LED strands as an image travels across the strands.

Figure 6:
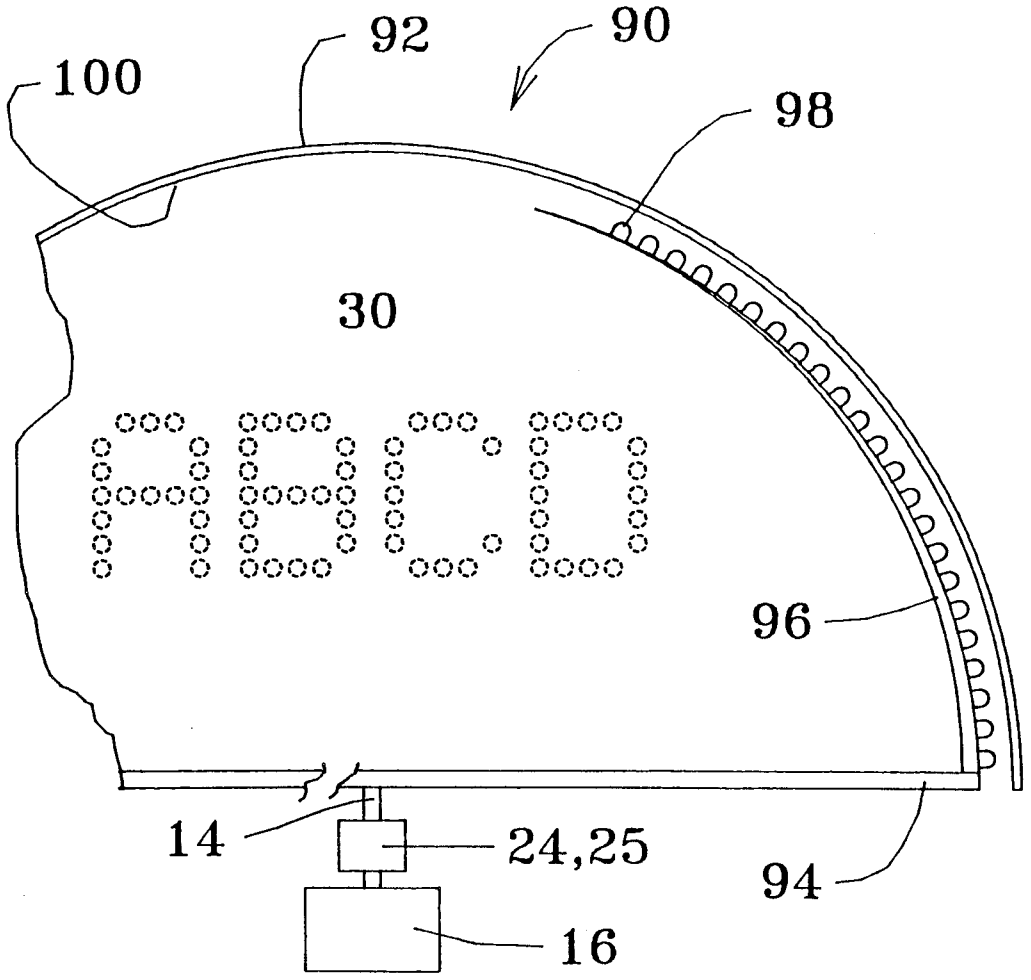
FIG. 6 is a fragmentary elevational side view of a third display device embodying principles of the invention and utilizing a liquid crystal film surface as a light valve to generate images.

In FIG. 6, there is illustrated a display device 90 embodying further principles of the invention. The device 90 includes a spherically-shaped liquid crystal film 92 that serves as a light valve. A rotary member 94 operates in the same fashion as the rotary member 12. However, the rotary member 94 carries thereon upstanding legs 96 each having a strand of energy emitting elements 98. In the illustrated embodiment, the energy emitting elements 98 are ion emitters.

When an ion emitter 98 is caused to emit an ion, the ion strikes an inner surface 100 of the liquid crystal film 92 causing the film 92 to appear transparent at the point of impact. Thus, at the point of impact, there exists a pixel.

The ion emitters 98 are driven in time division multiplexed fashion as the rotary member 92 is caused to rotate. Either of the circuits 40 or 60 can be utilized in connection with the device 90 to drive the ion emitters 98, as discussed above.

Additionally, the film 92 need not have a spherical shape. Instead, the film 92 may take on any desired shape. Of course, the shape of the upstanding leg 94 can be changed as needed to conform to the shape of the film 92.

Figure 7:
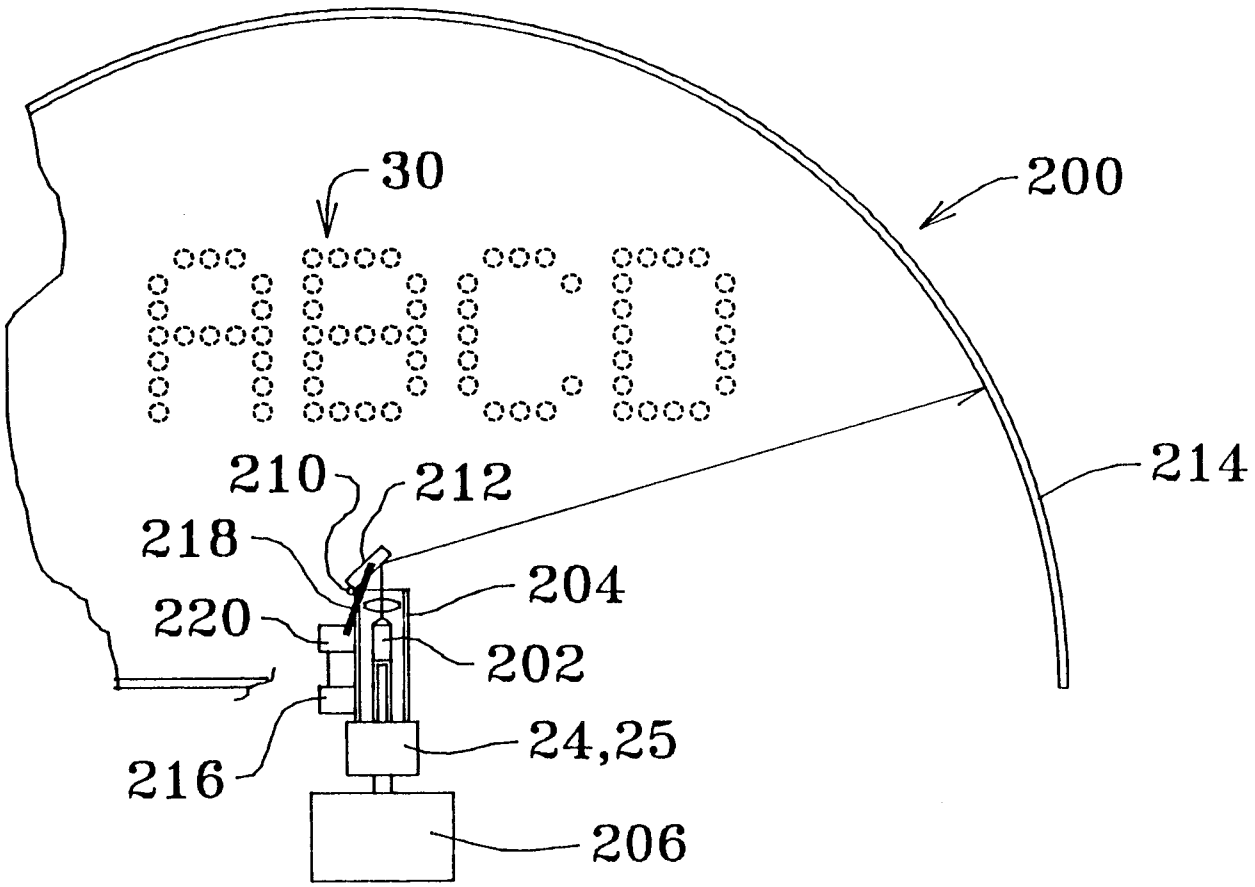
FIG. 7 is a fragmentary elevational side view of a fourth display device embodying principles of the invention and utilizing a laser diode in combination with a swivelable mirror to generate light images.

In FIG. 7, there is illustrated yet a further device 200 embodying principles of the invention. However, instead of utilizing a plurality of light image producing elements, the device 200 utilizes a single light image element 202. Possible single light image elements include energy emitting elements such as laser diodes, coherent/incoherent light emitters, and electron or ion emitters. As the basic principles for utilizing each single light image element are the same, the discussion continues as if a laser diode is employed as the single light image element 202.

The laser diode 202 is located along the central axis of and within a hollow shaft 204 that extends from a motor 206.

A reflecting surface 212 is hingedly mounted on a hinge 210 at an axial end of the hollow shaft 204. In the illustrated embodiment, the reflecting surface 212 is a mirror. The mirror 212 is hingedly attached to the hollow shaft 204 so that the mirror 212 can be used to redirect the light emitted by the laser diode 202 onto a luminescent surface 214. Wherever the light strikes, an observer will observe a lighted pixel or dot of light on the surface 214.

The pivoting of the mirror 212 is controlled by a controller 216 connected to a rod 218 and a carrier 220, which carrier is fixedly mounted relative to the mirror 212. The rod 218 is connected at one end to the mirror 212 and is carried within the carrier 220. The controller causes the rod 218 to move relative to the carrier 220 to thereby cause the mirror 212 to pivot.

Because the mirror 212 is mounted on a rotating base, it can cause the light from the laser diode 202 to be directed to any location of the spherical surface 216. As the mirror 212 is rotated, the laser diode 202 is caused to be turned on and off in time division multiplexed fashion. Thus, by rotating and pivoting the mirror 212 quickly enough, an image will appear on the surface 214 to an observer, though at any given instant, only a single pixel is caused to emit a light image.

It can be appreciated that in the embodiment illustrated in FIG. 7, in order to reduce wear and tear on the pivoting mechanism of the mirror 212 and the rod 218 associated therewith, the mirror is caused to make one complete rotation before pivoting. This reduces the amount of pivoting that would be required if the device 200 was caused to create light images in longitudinal lines.

Thus far, the display devices 10, 100, and 200 have been described wherein the light image sources utilized emit light images of only one color. For example, the LEDs 20 generally emit a red light image. However, color images can also be generated.

One scheme for producing color images involves designating visual attributes such as color, blink, inverse, intensity, and glitter to specific bits of a byte of memory in a random access memory store allocated to a CPU 42. In this scheme, each byte of memory is allocated to a pixel on the image surface. Thus, every pixel on the surface of the image has allocated to it eight attributes or bits.

In the contemplated scheme, bits 0–2 designate the color to be produced at a pixel. Thus, if tri-color LEDs are utilized, the LEDs can be caused to emit red, green, or yellow light depending upon the status of the bits 0–2. An alternative embodiment could employ red, green, and blue LED dyes to generate a wider spectrum of colors.

Bit 3 describes the intensity of the pixel of emitted light. A 1 can describe full intensity while a 0 can describe a lesser intensity. The generation of a lesser intensity light image by an LED can be accomplished by modulating the drive voltage thereof with a 50% duty cycle voltage waveform. This modulating waveform is high enough in frequency (i.e., above 60 Hz) to avoid noticeable flicker at the pixel.

Bit 4 describes the blink of a particular pixel. Setting this bit to describe blinking causes gating of a low frequency clock signal to the light image source voltage drive to turn same on and off, thereby causing blinking at the pixel.

Bit 5 describes the inverse status of the light image source to enable production of a reverse video effect. When this bit is set to describe inverse, the light image source color, intensity, and blink attributes are interpreted through complimentary logic and the pixel is caused to produce a highlighted effect.

Bit 6 describes the glitter of a particular pixel. When this bit is set, a pseudorandom sequence (PRS) clock is gated to the light image source drive associated with the pixel to modulate the pixel intensity in a pseudorandom fashion to generate a "starburst" effect on the displayed image.

Bit 7 is unused in the presently contemplated scheme.

While a preferred embodiment has been shown, modifications and changes may become apparent to those skilled in the art which shall fall within the spirit and scope of the invention. It is intended that such modifications and changes be covered by the attached claims.

We claim:

1. An apparatus for producing an optical illusion of an image, comprising:

a) light image means for producing a series of light images, said light image means comprising a surface of liquid crystal material having a three-dimensional characteristic and an energy emitting device, said liquid crystal material being addressable by said energy emitting device such that said surface acts as a light valve;

b) rotary means for carrying and rotating said energy emitting device; and c) drive circuit means coupled to said light energy emitting device for driving said light image means in time or position division multiplexed fashion in accordance with the rotational position of said energy emitting device relative to a fixed point.

2. An apparatus as set forth in claim 1, wherein said energy emitting device comprises a mirror mounted for rotation on a hollows haft and a light image element directing light energy along an axis of said shaft, said mirror selectively reflecting said light energy, said light image element being turned on and off in time division multiplexed fashion.

3. An apparatus as set forth in claim 1, wherein said rotary means comprises a member adapted for rotation about an axis.

4. An apparatus as set forth in claim 1, wherein said energy emitting device comprises a plurality of energy emitting elements.

5. An apparatus as set forth in claim 4, wherein said energy emitting elements comprise a plurality of ion emitters that cooperate with said liquid crystal material to produce light images.

6. An apparatus as set forth in claim 4, wherein said energy emitting elements comprise light emitting elements.

7. An apparatus as set forth in claim 2, wherein said light image element comprises a laser beam apparatus.

* * * * *